US006467251B1

(12) United States Patent
Kolmes

(10) Patent No.: US 6,467,251 B1
(45) Date of Patent: Oct. 22, 2002

(54) LIGHTWEIGHT COMPOSITE YARN

(75) Inventor: Nathaniel H. Kolmes, Hickory, NC (US)

(73) Assignee: Supreme Elastic Corporation, Hickory, NC (US)

( * ) Notice: Subject to any disclaimer, the term of this patent is extended or adjusted under 35 U.S.C. 154(b) by 0 days.

(21) Appl. No.: 09/721,179

(22) Filed: Nov. 22, 2000

(51) Int. Cl.[7] ..... D02G 3/06
(52) U.S. Cl. ..... 57/230; 57/210
(58) Field of Search ..... 57/210, 230

(56) References Cited

U.S. PATENT DOCUMENTS

| | | | | |
|---|---|---|---|---|
| 1,574,004 A | | 2/1926 | Ryder | |
| 2,609,653 A | | 9/1952 | Peterson | 57/145 |
| 3,336,744 A | | 8/1967 | Peene | 57/145 |
| 4,202,382 A | | 5/1980 | Westhead | 139/383 A |
| 4,290,260 A | | 9/1981 | Wasserman | 57/210 |
| 4,313,998 A | | 2/1982 | Pivot et al. | 428/222 |
| 4,384,449 A | | 5/1983 | Byrnes, Sr. et al. | 57/210 |
| 4,458,475 A | | 7/1984 | Schmit et al. | 57/243 |
| 4,470,251 A | | 9/1984 | Bettcher | 57/230 |
| 4,750,324 A | | 6/1988 | Tochacek et al. | 57/210 |
| 4,777,789 A | | 10/1988 | Kolmes et al. | 57/210 |
| 4,793,130 A | | 12/1988 | Togashi et al. | 57/210 |
| 4,838,017 A | * | 6/1989 | Kolmes et al. | 57/210 |
| 4,912,781 A | | 4/1990 | Robins et al. | 2/167 |
| 4,936,085 A | | 6/1990 | Kolmes et al. | 57/229 |
| 5,023,953 A | | 6/1991 | Bettcher | 2/126 |
| 5,070,540 A | | 12/1991 | Bettcher et al. | 2/2.5 |
| 5,119,512 A | | 6/1992 | Dunbar et al. | 2/167 |
| 5,146,628 A | | 9/1992 | Herrmann et al. | 2/161 R |
| 5,177,948 A | | 4/1995 | Kolmes et al. | 57/229 |
| 5,423,168 A | | 6/1995 | Kolmes et al. | 57/229 |
| 5,597,641 A | | 1/1997 | Suematsu et al. | 428/195 |
| 5,628,172 A | | 5/1997 | Kolmes et al. | 57/210 |
| 5,632,137 A | | 5/1997 | Kolmes et al. | 57/212 |
| 5,644,907 A | | 7/1997 | Kolmes et al. | 57/230 |
| 5,655,358 A | * | 8/1997 | Kolmes | 57/212 |
| 5,721,179 A | | 2/1998 | Shi et al. | 442/203 |
| 5,845,476 A | * | 12/1998 | Kolmes | 57/229 |

* cited by examiner

*Primary Examiner*—Rodney M. Lindsey
*Assistant Examiner*—James G. Smith
(74) *Attorney, Agent, or Firm*—Oblon, Spivak, McClelland, Maier & Neustadt, P.C.

(57) ABSTRACT

A lightweight composite cut-resistant yarn having a core that includes at least one fiberglass strand and at least one wire strand, a sheath strand of high performance yarn wrapped around the core, and at least one non-metallic, non-high performance cover strand wrapped around the core and core sheath.

13 Claims, 4 Drawing Sheets

LIGHTWEIGHT COMPOSITE YARN

FIELD OF THE INVENTION

The present invention relates generally to yarns, fabrics and protective garments knitted of such yarns. More particularly, the present invention relates to a lightweight cut-resistant composite yarn construction that provides effective cut resistance for a protective garment without sacrificing the comfort and tactile sensitivity of the wearer.

BACKGROUND OF THE INVENTION

In many industries, it is desirable to provide protective garments, particularly gloves, to protect employees from being cut. Ideally, such garments should provide an acceptable amount of cut resistance while possessing suitable flexibility and durability. To this point knit garments having these qualities have been constructed with constituents of wire or high performance fibers. "Cut resistance," as used herein, refers to the ability to prevent laceration or puncture of the garment by sharp objects such as knives. High performance fibers include SPECTRA®, KEVLAR®, and CERTRAN®. To date, composite cut-resistant yarns have been constructed using a wrapping technique wherein a core of single or multiple strands is wrapped with one or more additional strands. Either the core or the wrap strands may include strands comprised of cut-resistant material.

In addition to their higher costs, the use of high performance fibers alone in the core or wrap strands to make cut-resistant composite yarns and garments have not come without certain disadvantages. Articles made from these high performance fibers may be stiff and bulky, particularly in the case of protective gloves, and cause the wearer to fatigue more quickly with an attendant loss of tactile sensation. This is due in large part to the higher weight per unit length, or denier, of the high-performance fibers used to achieve an acceptable level of cut resistance. Such lose of sensitivity can create a hazardous situation. for workers in industries such as meat packing.

Responsive to the disadvantages created with yarn constructions solely utilizing high performance core and/or wrap strands for cut-resistance, cut-resistant yarns in which one or more wire strands are wrapped around a core of soft, conventional material such as fiberglass have been developed. While these yarns have proven more flexible, and to some extent less expensive, than those formed solely from high performance constituents, using wire to form yarn has also proven problematic. Specifically, when knitting with such yarn, unprotected or unshielded wire easily becomes knotted and kinked, or otherwise damaged. While not materially altering the fabric structure of the finished glove or other garment, garments formed from the fabric have proven quite uncomfortable to the wearers despite the use of softer fiberglass constituents in the yarn.

SUMMARY OF THE INVENTION

The present invention relates to a composite cut-resistant yarn that includes a lightweight core, a sheath, and a wrap. An object of the present invention is to provide a composite yarn that maximizes the advantages of both high performance fibers and wire in a single construction, while substantially reducing the inherent problems when either constituent is used separately. As such, another object of the present invention is to effectively reduce wire damage, weight, and stiffness in the composite yarn.

The core of the present invention includes at least one lightweight fiberglass strand in combination with at least one strand of wire. The wire may be twisted with or wrapped around the fiberglass strand, but is desirably placed in parallel with the fiberglass strand so that bending and twisting of the wire is minimized. While wire used alone as a core produces a stiff and hard hand, this is offset by the use of the softer fiberglass as a cushion strand. For this lightweight yarn, a single fiberglass strand is desirably about 100 denier, but may be up to 600 denier depending on the particular application. For strength, cut-resistance, and corrosion resistance, the core strand of wire is typically formed of annealed stainless steel with a diameter between about 0.0016 and 0.0020 inches, and desirably 0.0016 inches.

At least one sheath strand of high performance yarn, such as SPECTRA®, is wrapped around the fiberglass and wire core at between about 4 and 12 turns per inch. In the preferred embodiment, the high performance sheath strand is 200 to 215 denier; however, a sheath strand of up to 375 denier has been found to substantially improve the cut-resistance of the yarn, while significantly eliminating the knotting and kinking problems inherent in a construction using only wire. Chiefly, however, the combination of wire and high performance yarn enables a lightweight yarn construction with cut resistance rivaling that of significantly heavier constructions.

The lightweight yarn further includes at least one non-metallic, non-high performance cover strand of a more conventional material wrapped around the core and the sheath. This cover is preferably formed of polyester because of the low shrinkage characteristics of polyester; however, nylon, acrylic, polyester/cotton blend, cotton, or wool are also suitable alternatives. Where a single cover strand is used, a polyester with a denier up to about 200 provides the desired results, with 100 denier being preferred. Desirably, a second non-metallic, non-high performance cover strand is wrapped around the first cover in a direction opposite that of the first cover strand. While one cover is adequate in providing a soft hand in this construction, a second cover provides extra softness, albeit a slightly heavier yarn.

A variety of gloves, sleeves, and other cut-resistant products may be formed from the lightweight yarn of the present invention. Because a variety of yarn deniers and wire sizes may be used in forming the cut-resistant yarn described herein, the yarn may be used on knitting machines with gauges between 7 and 15.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

BRIEF DESCRIPTION OF THE DRAWINGS

The various benefits and advantages of the present invention will be more apparent upon reading the following detailed description of the invention taken in conjunction with the drawings.

DETAILED DESCRIPTION OF THE PREFERRED EMBODIMENTS

Figure 1:
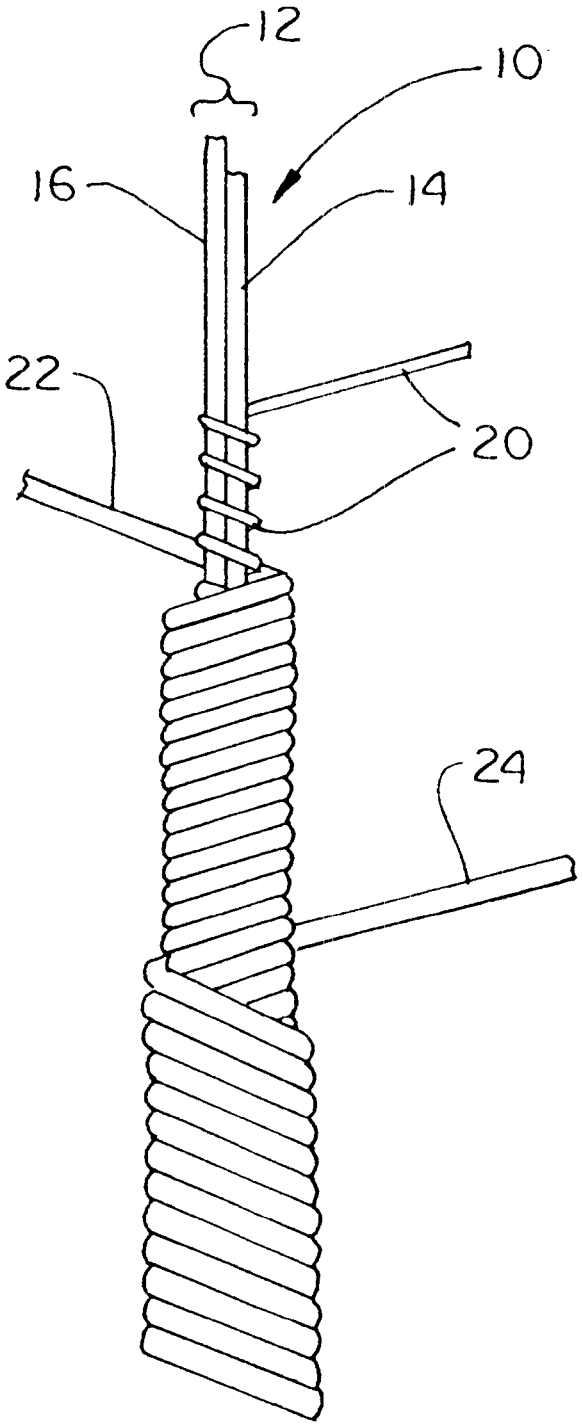
FIG. 1 is a schematic illustration of a preferred embodiment of the composite cut-resistant yarn of the present invention including a fiberglass and wire core, a core sheath strand, and two cover strands.
Figure 2:
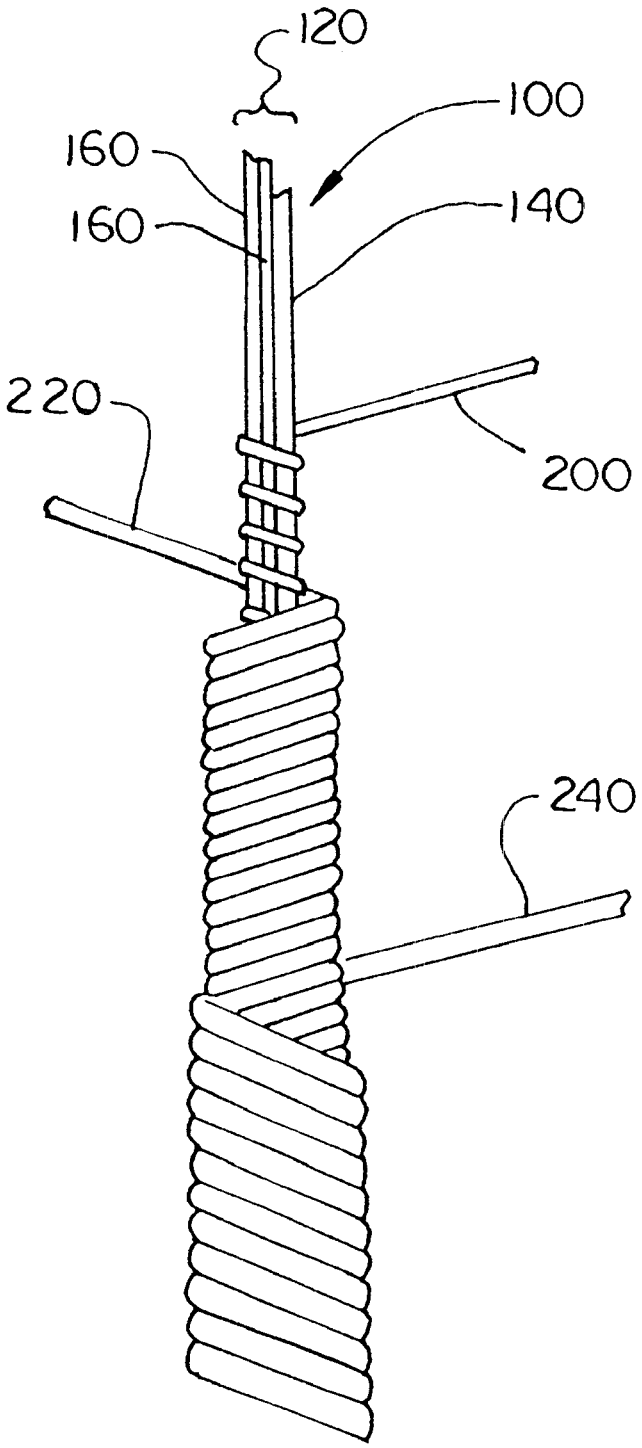
FIG. 2 is a schematic illustration of an alternative embodiment of the present invention including two core strands of fiberglass.
Figure 3:
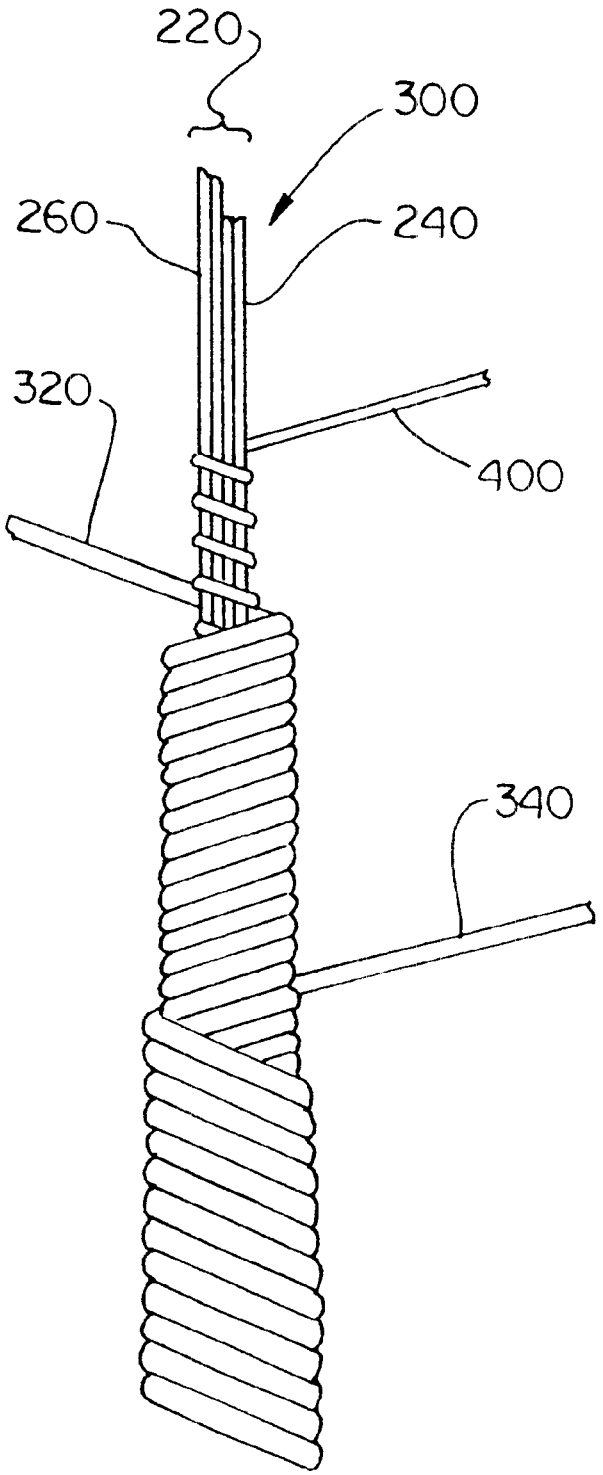
FIG. 3 is a schematic illustration of an alternative embodiment of the present invention including a core of two strands of fiberglass and two strands of wire.

The present invention is directed to a lightweight cut-resistant yarn constructed to have superior cut-resistance properties, but which maximizes comfort when incorporated into items such as gloves. In general, the yarns of the present invention are formed with a core containing fiberglass and wire in substantially parallel relation, a cover sheath of high-performance yarn, and one or more outer covers of natural or manmade non-metallic, non-high performance strands. FIGS. 1 through 3 are exemplary, but not exhaustive of the various embodiments that may be formed.

Turning to FIG. 1, there is illustrated one embodiment of a lightweight cut-resistant yarn 10 which includes a core 12 formed of a fiberglass strand 4 and a wire strand 16 in substantially parallel relation. A core sheath strand 20 of high performance material is wrapped around the fiberglass and wire core 12. The cut resistant yarn 10 further includes at least one, and as shown in FIG. 1, desirably two non-metallic, non-high performance cover strands 22, 24 that are wrapped around the core 12 and core cover sheath 20. Desirably, the second, or top cover strand 24 is wrapped in a direction opposite that of the first, or bottom cover strand 22.

As shown in FIG. 2, an alternative embodiment of a lightweight cut-resistant yarn 100 includes a core of with a single fiberglass strand 140 and two wire strands 160, wherein the two wire strands 160 are in substantially parallel relation with each other and with fiberglass strand 140. A sheath strand 200 of high performance yarn is wrapped around the fiberglass 140 and wire 160 core. Again, at least one, and desirably two, cover strands 220, 240 are wrapped around the core and core sheath in opposite directions.

FIG. 3 illustrates another embodiment of a composite cut-resistant yarn 300 that includes a core with two fiberglass strands 240 and two wire strands 260, wherein the two wire strands 260 are in substantially parallel relation with each other and with the two fiberglass strands 240. A core sheath strand 400 of high performance yarn is wrapped around the fiberglass 240 and wire 260 core. Two cover strands 320, 340 are wrapped around the core and core sheath in opposite directions.

The fiberglass strand (or strands) in the core may be either E-glass or S-glass that is either continuous multi-filament or spun. The practice of the present invention contemplates using several different sizes of commonly available fiberglass strands, as illustrated in Table 1 below:

TABLE 1

| Fiberglass Size | Approximate Denier |
|---|---|
| G-450 | 99.21 |
| D-225 | 198.0 |
| G-150 | 297.6 |
| G-75 | 595.27 |

The size designations in the Table are well known in the art to specify fiberglass strands.

These fiberglass strands may be used singly or in combination depending on the particular application for the finished article. By way of non-limiting example, if a total denier of about 200 is desired for the fiberglass component of the core, either a single D-225 or two substantially parallel G-450 strands may be used. In a preferred embodiment either a single strand or a combination of strands will have a denier of about between 100 and about 600.

It should be understood that the table above illustrates currently available fiberglass strand sizes. The practice of the present invention contemplates the use of other fiberglass strand sizes as they become available in the market or as found to be suitable for particular applications.

Suitable types of fiberglass yarn are manufactured by Corning and by PPG. The yarn has the desirable properties of relatively high tenacity, of about 12 to about 20 grams per denier, are resistant to most acids and alkalis, are unaffected by bleaches and solvents, are resistant to environmental conditions such as mildew and sunlight, and are highly resistant to abrasion and aging.

The wire used in the practice of the present invention has a diameter of between about 0.0016 inches and 0.0020 inches, and is desirably about 0.0016 inches. Where two wires are used, the combined diameter should not exceed about 0.0020 inches. The wire strands of the present invention desirably are formed from an annealed stainless steel with the particular diameter of wire being selected based on the desired properties and end use of the yarn.

In the preferred embodiment, the sheath strand has a denier of about 200 to 215. The sheath strand may have a denier of up to 375 d and is formed of fibers or filaments selected from the group consisting of high performance yarns such as extended chain polyethylene or aramid. As used herein, "high performance" means that the fibers or filaments have a tenacity of at least 10 grams/denier. The sheath strand is wrapped at between about 4 and 12 turns per inch. A wrap rate of between about 4 and 12 turns per inch has been found to provide adequate protection for the underlying wire while maximizing the cut resistance of the finished yarn construction.

The selection of the sheath strand will depend in part on the desired properties and end use of the finished yarn. For example, an extended chain polyethylene such as that sold under the SPECTRA® brand may be used for its durability and abrasion resistance. Other suitable materials include aramids such as Dupont's KELVAR®, or a polyethylene such as CERTRAN® manufactured by Hoechst Celanese. CERTRAN® is believed to provide performance similar to SPECTRA® at a lower cost.

The first cover strand and, if used, the second cover strand are natural or manmade non-metallic non-high performance. The strands may be provided in either spun or filament form within a denier range of about 70 to about 200. Desirably, these strands are about 70 denier. Each cover strand is wrapped around the core and core sheath at between about 4 and 12 turns per inch. Where a bottom and top cover strand are used, one will be wrapped in a direction opposite that of the other. Suitable materials for the cover strands include polyester, polyester/cotton blends, acrylic, and various types of nylon, wool and cotton. The choice of a particular material for the cover strand or strands will vary depending on the end use of the composite yarn and the physical characteristics (appearance, feel, etc.) desired for the yarn.

Preferably, the overall size of the yarn of the present invention to include the fiberglass and wire core, core sheath strand, and cover strands will permit forming the yarn into knitted products on 7 gauge to 15 gauge knitting machines, and desirably 15. This approximately equates with a composite yarn denier of about 1800 or less.

The yarn of the present invention may be manufactured on standard yarn-making equipment. The core strands of fiberglass and wire are laid side by side. Alternatively, the wire strand may be wrapped around the fiberglass strand at between about 4 and 12 turns per inch. The core sheath strand is then wrapped around the composite core. The bottom cover is wrapped around the core and core sheath in a direction opposite that of the sheath strand. Finally, the top cover (where two cover strands are used) is wrapped around the bottom cover, but in a direction opposite that of the bottom cover.

The yarn of the present invention has several advantages over yarn constructions that utilize high performance cores or core sheaths for cut resistance, but which do not include wire strands. Likewise, the present invention has several advantages over yarn constructions that include wire in the cores or as core wraps, but do not include high performance strands. The fiberglass and wire composite core and the high performance sheath strand of the present invention are mutually beneficial to each other, permitting a lighter construction having both superior cut resistance and superior hand. Properties of the resulting yarn may be altered by varying the diameters of the fiberglass or wire core strands, the sheath strand, or the cover strand(s). The wrap rate of each may also be varied to produce the desired properties.

The cut resistance of the yarn of the present invention is illustrated in Table 2 below and compared with the cut resistance of other yarn constructions formed with either wire strands or high performance strands, but not both. Testing was conducted using ASTM test procedure F 1790-97. For this ASTM test, the reference force is the mass required (in grams) for the cutting edge of the test apparatus to travel one inch and "cut through" the material being testing. The mass is determined by interpolating at least five cut through tests.

TABLE 2

| Sample | Core | Core Wrap | 1st Cover | 2nd Cover |
|---|---|---|---|---|
| Present Invention (2,668 g) | G-450 (100 Denier) Fiberglass; .0016 Wire | Spectra ® 215 Denier | Polyester 70 Denier | Polyester 70 Denier |
| A (3,249 g) | G-37 (1200 Denier) Fiberglass | 2X — 0.0016 Wire | Polyester 500 Denier | Nylon 1000 Denier |
| B (3,004 g) | G-37 (1200 Denier) Fiberglass | 2X — 0.0016 Wire | Spectra ® 215 Denier | Spectra ® 375 Denier |
| C (3,386 g) | G-37 (1200 Denier) Fiberglass | Spectra ® 650 Denier | Spectra ® 650 Denier | Polyester 1000 Denier |
| D (3,251 g) | G-75 (600 Denier) Fiberglass | Spectra ® 650 Denier | Spectra ® 650 Denier | Polyester 1000 Denier |
| E (2,017 g) | G-450 (100 Denier) Fiberglass | Spectra ® 200 Denier | Polyester 70 Denier | Polyester 70 Denier |

As shown in Table 2, the mass required for "cut through" of fabric formed from yarn constructed according to a preferred embodiment of the present invention was 2,668 grams. For purposes of comparison, Samples A and B are yarn constructions having fiberglass cores and core wraps/sheaths of annealed stainless steel wire. In both samples, the fiberglass cores are approximately 12 times the size of the fiberglass used in the core of the present invention. In both samples, two strands of 0.0016 inch (0.0032 inches total) wire were used to wrap the fiberglass cores, compared to a single strand of 0.0016 inch wire formed in parallel arrangement with the fiberglass core strand of the present invention. Finally, the cover strand used in Samples A and B are from 8 to 21 times the weight per unit length (denier) of the combined cover strands of the present invention, yet both samples have twice the wire of the present invention. However, the cut through masses for Samples A and B are only 12% to 21% higher than that of the present invention, despite their bulk and heavier weight constructions.

Samples C and D are illustrative of yarn constructions formed with high-performance core sheaths, but with no wire. Here the fiberglass cores are 6 to 12 times the denier of the fiberglass core of the present invention, with composite deniers approximately 6 to 8 times that of the present invention. Yet, the cut through masses for Samples C and D are only 26% and 21%, respectively, higher than that of the present invention.

Finally, as shown in Table 2, Sample E has a construction similar to the present invention, except that it has no wire in the core. As shown, the single strand of 0.0016 inch wire results in approximately 32% more cut through mass.

Figure 4:
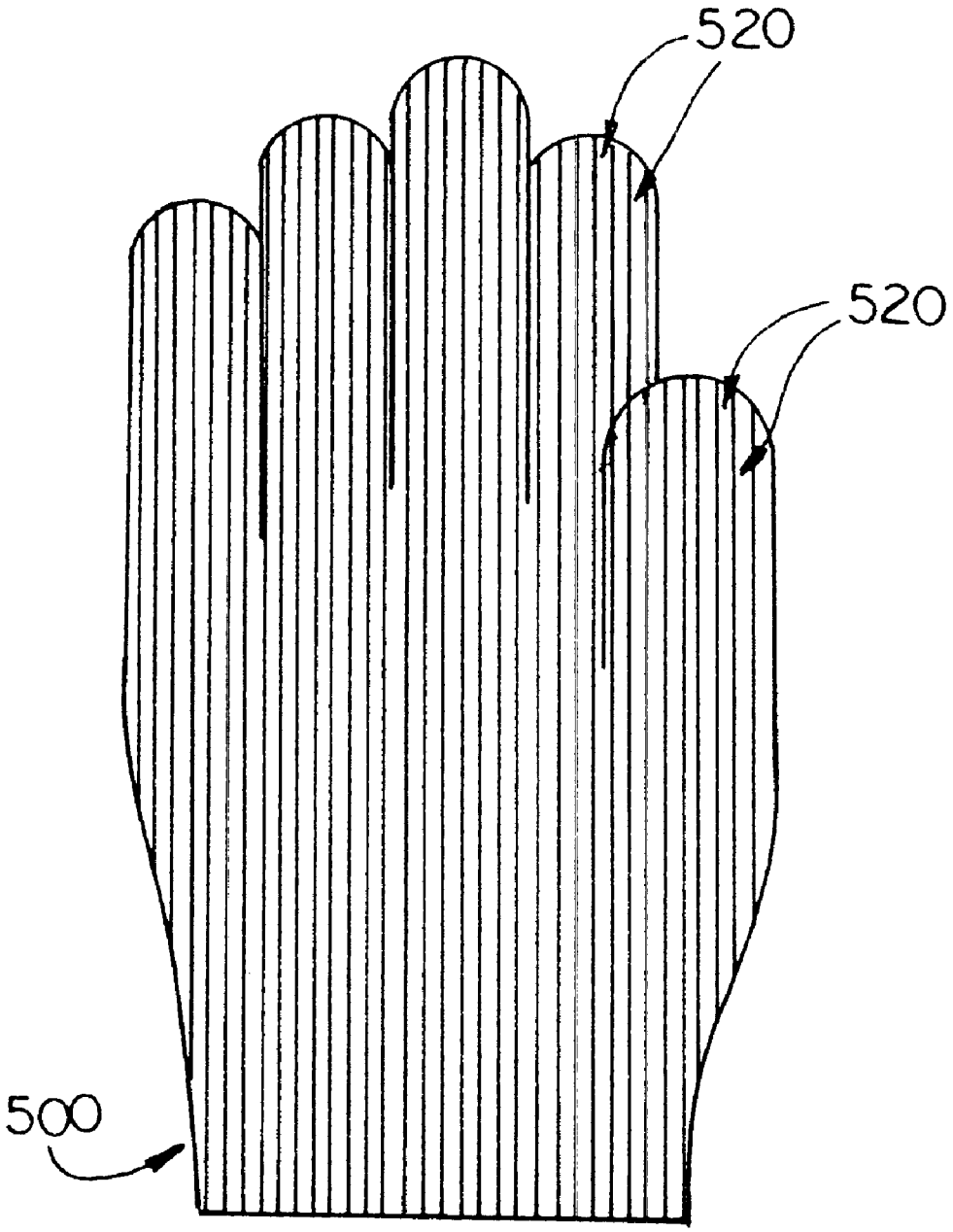
FIG. 4 is a schematic illustration of a glove constructed using the yarn of the present invention.

Turning to FIG. 4, a cut and abrasion resistant glove 500 according to the present invention is illustrated. The lightweight glove incorporates finger stalls 520 for each of the wearer's fingers. The cut-resistant yarn may also be incorporated into a variety of other types of cut resistance garments and articles to include arm shields, aprons or jackets.

Although the present invention has been described with preferred embodiments, it is to be understood that modifications and variations may be utilized without departing from the spirit and scope of this invention, as those skilled in the art would readily understand.

What is claimed is:

1. A lightweight composite cut-resistant yarn comprising:

a. a core including at least one fiberglass strand having a denier of between about 100 and 600, and at least one wire strand having a diameter of between about 0.0016 inches and 0.0020 inches;

b. at least one sheath strand of high performance yarn wrapped around said core, said sheath strand having a denier of between about 200 and 375;

c. at least one non-metallic, non-high performance cover strand wrapped around said core and said sheath in a first direction, said at least one cover strand having a denier of between about 70 and 200 and formed of material selected from the group consisting of polyester, polyester/cotton blends, nylon, acrylic, cotton, and wool;

d. the total denier of fiberglass strand(s) being no greater than 600, the combined diameter of the wire strand(s) being no greater than 0.0020 inches, and the total denier of the composite yarn being less than 1800.

2. The cut-resistant yarn of claim 1 wherein said at least one fiberglass strand and at least one wire strand are formed in substantially parallel relation.

3. The cut-resistant yarn of claim 1 further including a second non-metallic, non-high performance cover strand wrapped around said core and said sheath in a second direction opposite that of said at least one cover strand direction, said second non-metallic, non-high performance cover strand selected from polyester, polyester/cotton blends, nylon, acrylic, cotton, and wool.

4. The cut-resistant yarn of claim 1 wherein said sheath strand is wrapped around said core at a rate of between about 4 and 12 turns per inch, said core sheath strand formed of material selected from the group consisting of a polyethylene, an extended chain polyethylene and an aramid.

5. The cut-resistant yarn of claim 1 wherein said at least one non-metallic, non-high performance cover strand is wrapped at a rate of between about 4 and 12 turns per inch.

6. The cut-resistant yarn of claim 2 wherein said second non-metallic, non-high performance cover strand is wrapped at a rate of between about 4 and 12 turns per inch.

7. A cut and abrasion-resistant glove formed primarily of a composite cut-resistant yarn comprising:

a. a core including at least one wire strand having a diameter of between about 0.0016 inches and 0.0020 inches;

b. at least one core sheath strand of high performance yarn wrapped around said core;

c. at least one non-metallic, non-high performance cover strand wrapped around said core and said core sheath in a first direction, said at least one cover strand having a denier of between about 70 and 200 and formed of material selected from the group consisting of polyester, polyester/cotton blends, nylon, acrylic, cotton, and wool;

d. the total denier of fiberglass strand(s) being no greater than 600, the combined diameter of the wire strand(s) being no greater than 0.0020 inches, and the total denier of the composite yarn being less than 1800.

8. The cut and abrasion-resistant glove of claim 7 wherein said at least one fiberglass strand and at least one wire strand are formed in substantially parallel relation.

9. A lightweight composite cut-resistant yarn comprising:

(a) a core including a fiberglass strand and a wire strand, said fiberglass strand and said wire strand formed in substantially parallel relation;

(b) a sheath strand of high performance yarn wrapped around said core; and (c) at least one non-metallic, non-high performance cover strand wrapped around said core and said core sheath in a first direction, said at least one cover strand formed of material selected from the group consisting of polyester, polyester/cotton blends, nylon, acrylic, cotton, and wool; and (d) wherein the composite denier of said cut-resistant yarn is less than about 1800.

10. The cut-resistant yarn of claim 9 wherein the denier of said fiberglass strand is between about 100 and 600.

11. The cut-resistant yarn of claim 9 wherein the diameter of said wire strand is between about 0.0016 and 0.0020 inches.

12. The cut-resistant yarn of claim 9 wherein the denier of said sheath strand is between about 200 and 375.

13. The cut-resistant yarn of claim 9 wherein the denier of said at least one cover strand is between about 70 and 200.

* * * * *